United States Patent [19]

Josephs

[11] 4,013,803

[45] Mar. 22, 1977

[54] FABRICATION OF AMORPHOUS BUBBLE FILM DEVICES

[75] Inventor: Richard M. Josephs, Willow Grove, Pa.

[73] Assignee: Sperry Rand Corporation, New York, N.Y.

[22] Filed: Oct. 30, 1975

[21] Appl. No.: 627,417

[52] U.S. Cl. ..... 427/8; 427/58; 427/93; 427/96; 427/123; 427/124; 427/125; 427/131; 427/132; 427/250; 427/255; 204/192 M

[51] Int. Cl.[2] ..... B05D 5/12; C23C 11/00

[58] Field of Search ..... 427/131, 132, 58, 93, 427/8, 125, 250, 255, 96, 124, 123; 428/538, 539; 204/192

[56] References Cited

UNITED STATES PATENTS

| | | | |
|---|---|---|---|
| 3,836,898 | 9/1974 | Bobeck et al. | 340/174 SR |
| 3,909,810 | 9/1975 | Naden | 340/174 ED |
| 3,932,688 | 1/1976 | Sugita | 427/132 |
| 3,946,124 | 3/1976 | Mee | 427/8 |

OTHER PUBLICATIONS

Hasegawa, Jour. of Appl. Phys., *Static Bubble . . . GdCo Films*, vol. 45, No. 7 (7–1974) pp. 3109–3112.

Ziegler et al, Appl. Phys. Lett., *Thermal Stability . . . Metallurgy*, vol. 24, No. 1, (1–1974) pp. 36–39.

Chaudhari et al, IBM Tech. Discl. Bulletin, *Multilayer . . . Making*, vol. 16, No. 12 (5–1974) pp. 4100–4101.

Ahn et al, IBM Tech. Dis. Bulletin, Recessed Overlay Structure, vol. 17, No. 10 (3–1975), p. 3172.

Giess et al, IBM Tech. Dis. Bulletin, *Conveyor Sheet . . . Systems*, vol. 17, No. 2 (7–1974), p. 625.

Doo, IBM Tech. Dis. Bulletin, *Fabricating . . . Domain*, vol. 15, No. 5 (10–1972), p. 1585.

Suits, IBM Tech. Dis. Bulletin, *Discontinuous . . . Applications*, vol. 17, No. 9 (2–1975), p. 2761.

Hu et al, IBM Tech. Dis. Bulletin, Bubble Domain . . . Display, vol. 17, No. 8 (1–1975), p. 2495.

*Primary Examiner*—Michael F. Esposito

*Attorney, Agent, or Firm*—Rene A. Kuypers

[57] ABSTRACT

The invention discloses a technique for fabricating an amorphous (i.e., non-crystalline) bubble device which enables high quality permalloy films for drive circuits and magneto-resistors to be deposited without destroying the magnetic properties of the amorphous film.

5 Claims, 2 Drawing Figures

FABRICATION OF AMORPHOUS BUBBLE FILM DEVICES

BACKGROUND OF THE INVENTION

1. Field of the Invention

This invention relates to the field of bubble memory devices and in particular to the amorphous bubble type.

2. Description of the Prior Art

The fabrication of present day amorphous bubble films has followed the prior art process for the fabrication of conventional (i.e., crystalline) garnet films. This prior art process generally comprises depositing a bubble film at a relatively high temperature on top of a non-magnetic substrate. An insulator overlay is then placed over the bubble film after which a permalloy film, which is utilized for the magnetic field access circuitry, is deposited. This permalloy film is deposited at a lower temperature than the bubble film deposition, but nevertheless at a high temperature.

When the above process is applied to the amorphous bubble devices, several problems have been encountered by the prior art. In contrast to garnet films, amorphous films must be deposited at a relatively low temperature. Therefore, subsequent processing after the amorphous film has been deposited on a substrate must be done at low temperatures to prevent the amorphous films from crystallizing. This leads to several undesirable features in the permalloy drive layer in that the permalloy films tend to exhibit poor adhesion and high coercivity. One approach to avoiding these problems has been to use Ni Fe laminates. This multilayer structure is considerably more complicated so that the remedies have tended to complicate the permalloy structure. This complication has been evidenced by the paper "Electron-Beam Fabrication of High-Density Amorphous Devices," IEEE Trans. Mag 11, 1142 (1975).

SUMMARY OF THE INVENTION

The invention comprises a fabrication procedure for amorphous bubble films wherein the various metallization and quartz layers are first placed on the substrate at temperatures high enough to produce films of the desired quality. At this stage of the fabrication, the defective units can be discarded, whereas the final step consisting of the low temperature deposition of the amorphous film is performed on the good units. The low temperature deposition can be made last since the high temperature evaporations were deposited first.

It is therefore the object of the invention to describe a new method of fabricating amorphous bubble film devices which simultaneously preserves the desired magnetic properties of the amorphous film and also the Ni Fe drive circuit and magneto-resistor.

DESCRIPTION OF THE PREFERRED EMBODIMENTS

Figure 1:
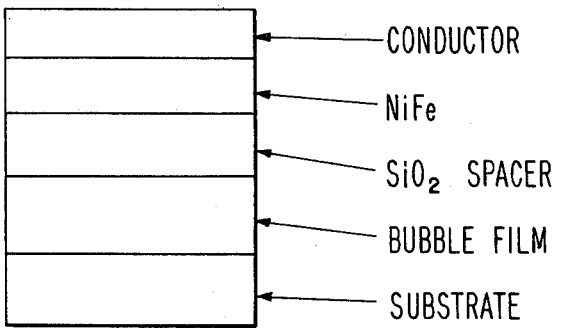
Fig. 1 PRIOR ART
FIG. 1 depicts the prior art process for fabricating amorphous films.

Referring now to FIG. 1 in greater detail there is depicted the fabrication steps utilized by the prior art for a conventional bubble garnet film device. This process has been utilized with modifications in the prior art fabrication of amorphous bubble devices. The process steps for a conventional bubble device are as follows.

A non-magnetic substrate which is comprised of $Gd_3Ga_5O_{12}$ (gadolium gallium garnet) is obtained upon which is deposited by the liquid phase epitaxy technique a magnetic garnet bubble film of, for example, $Y_{2.38}La_{.09}Eu_{.53}Fe_{3.9}Ga_{1.1}O_{12}$ (Yttrium Lanthanium Europium Iron Gallium Garnet). This magnetic garnet film is deposited at a temperature of approximately 950° C. A $SiO_2$ or quartz spacer is then sputtered on the bubble film after which the permalloy or Ni Fe film is deposited by evaporation at a temperature of approximately 325°–350° C. A T-bar pattern is delineated by photolithography after which the T-bar path is etched out of the solid permalloy layer. An Au or Al-4% Cu layer is then deposited by evaporation over the T-bar pattern. The Al Cu layer is then patterned to form various conductor elements required during the operation of the memory.

When the above process is applied to the fabrication of amorphous films it is found that subsequent processing, after the bubble film is deposited at approximately room temperature, must be at a low temperature in order that the bubble film may not crystallize. However, since the Ni Fe layer must be evaporated at a temperature of approximately 325° C, whereas a lower temperature must be utilized because of the amorphous film, the Ni Fe film tends to exhibit poor adhesion, high coercivity and low values of the magneto-resistive effect. These are undesirable features in the Ni Fe drive and magneto-resistor elements. These problems are avoided or minimized by the bubble device fabrication depicted in FIG. 2.

Figure 2:
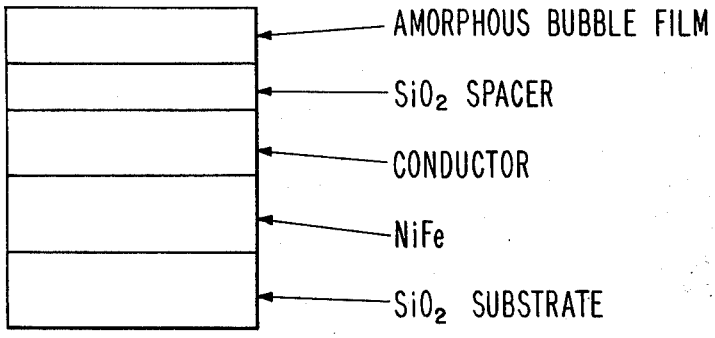
FIG. 2 shows the fabrication process utilized with the instant invention.

In FIG. 2, a quartz substrate is utilized. As is well-known in the art, any non-crystalline substrate such as glass or quartz, as well as crystalline silicon, may be utilized for amorphous film fabrication. The various metallization layers including the Ni Fe and Au or Al Cu are next successively deposited at temperatures high enough to produce films of the desired quality. As in the prior art process, the Ni Fe is deposited at approximately 325° C.

At this stage of the fabricating process, an inspection is made of the bubble units. The units that are not satisfactory may be discarded. This procedure produces economy of manufacture over the previously known process since in the prior art the Ni-Fe and the Au or Al Cu layers are evaporated after the bubble film is deposited. Accordingly, if a bubble device is discarded because of a defect in the metallization layers (i.e., Ni Fe, Au or Al Cu), a complete bubble unit must be thrown away. However, in the process of FIG. 2, the bubble unit need not be completed if the metallization layers are not satisfactory.

If the metallization is properly deposited on the quartz or $SiO_2$ substrate, a quartz spacer is sputtered thereon. The final step consists of the low temperature formation of the amorphous bubble film. The low temperature bubble film formation is done at a deposition temperature range of −166° C to 25° C.

What is claimed is:

1. The method of fabricating an amorphous bubble film memory device of the type having a plurality of layers comprising essentially a substrate layer, a bubble film layer, an insulating layer, a magnetic film layer and a conductor layer wherein the improvement consists of:

a. forming said amorphous bubble film as the topmost layer of said plurality of layers.

2. The method of providing a single layer amorphous bubble film memory device on a substrate including the steps of, a. depositing a Ni Fe film on said substrate;
b. etching a bubble-mover circuit on said Ni Fe film;
c. forming a conductor on said bubble-mover circuit;
d. depositing a spacer on said conductor;
e. depositing said amorphous bubble film on said spacer.

3. The method of providing said bubble film device in accordance with claim 2 wherein the depositing step of the Ni Fe is at a temperature of approximately 325° C.

4. The method of providing said bubble film device in accordance with claim 2 wherein said film is deposited at a temperature range between −166° C to 25° C.

5. The method of providing an amorphous bubble film device in accordance with claim 2 including the steps of, a. evaluating said device after the Ni Fe and conductor films have been formed;
b. discarding said device if the Ni Fe and/or the conductor films are defective;
c. continuing with the deposition of said spacer and amorphous bubble films after said Ni Fe and conductor films are found useable.

* * * * *